United States Patent [19]

Hyldgaard

[11] Patent Number: 5,014,652

[45] Date of Patent: May 14, 1991

[54] FLUID BED COOLER, A FLUID BED COMBUSTION REACTOR AND A METHOD FOR THE OPERATION OF A SUCH REACTOR

[75] Inventor: Niels J. Hyldgaard, Arden, Denmark

[73] Assignee: Aalborg Boilers A/S, Aalborg, Denmark

[21] Appl. No.: 435,371

[22] PCT Filed: Mar. 3, 1989

[86] PCT No.: PCT/DK89/00049

§ 371 Date: Jan. 3, 1990

§ 102(e) Date: Jan. 3, 1990

[87] PCT Pub. No.: WO89/08225

PCT Pub. Date: Sep. 8, 1989

[30] Foreign Application Priority Data

Mar. 4, 1988 [DK] Denmark ..... 1202/88

[51] Int. Cl.[5] ..... B09B 3/00; F22B 1/00

[52] U.S. Cl. ..... 122/4 D; 165/104.16; 122/483

[58] Field of Search ..... 165/104.16; 122/4 D, 122/483; 422/139

[56] References Cited

U.S. PATENT DOCUMENTS

| | | | |
|---|---|---|---|
| 4,184,455 | 1/1980 | Talmud et al. | 122/4 D |
| 4,312,301 | 1/1982 | Anson | 122/4 D |
| 4,321,233 | 3/1982 | Tsudi et al. | 122/4 D X |
| 4,469,050 | 9/1984 | Kurenberg | 122/4 D |
| 4,473,032 | 9/1984 | Maintok | 122/4 D |
| 4,716,856 | 1/1988 | Beisswenger et al. | 122/4 D |
| 4,753,177 | 6/1988 | Engström et al. | 122/4 D |
| 4,813,479 | 3/1989 | Wahlgren | 122/4 D X |

FOREIGN PATENT DOCUMENTS

| | | |
|---|---|---|
| 161970 | 11/1985 | European Pat. Off. . |
| 2148734 | 6/1985 | United Kingdom . |

OTHER PUBLICATIONS

VGB Kraftwerkstechnik, vol. 67, No. 6, Jun. 1987, Essen de, pp. 555–556; G. Daradimos and I. Dreher: "Inbetriebsetzung und Betriebsverhalten der Wirbelschichtfeuerung".

VGB Kraftwerkstechnik, vol. 67, No. 5, May 87, Essen de, pp. 446–449; H. Langner et al., "Auslegung und Konstruktion des Damperzeugers der ZAWSF. STadtwerke Dufsburg".

*Primary Examiner*—Edward G. Favors

*Attorney, Agent, or Firm*—Fleit, Jacobson, Cohn, Price, Holman & Stern

[57] ABSTRACT

A fluid-bed combustion reactor (51) comprising a substantially vertical reactor chamber with a first inlet (9) at the reactor chamber lower portion (52) for the introduction of liquid and/or solid particulate material, and a second inlet (22) at a level below the first inlet for the introduction of gas for fluidization of particulate material within the reactor in order to maintain a primary fluid bed, an exhaust duct (28) at the reactor chamber upper portion for the withdrawal of exhaust gas and particles from the reactor, and a fluid-bed cooler (42) for particular material, formed as an upwards open vessel with generally closed bottom and side walls and arranged so as to collect a portion of particulate material (64, 65) from the reactor chamber upper portion, said cooler comprising heat transfer means (43) such as tubes carrying a heat transfer medium at the inside and having said particulate material flowing at the outside, said cooler comprising at least one conduit (56) for the controlled returning of particulate material from the cooler to the primary fluid bed, and said cooler having inlets at the bottom wall (68) for introduction of gas for fluidization of particulate material. The heat transfer means are divided into at least two sections, and the inlets for fluidization gas are divided into sections corresponding with the heat transfer means sections and provided with separate control means for the inflow of fluidization gas into each section.

20 Claims, 6 Drawing Sheets

FLUID BED COOLER, A FLUID BED COMBUSTION REACTOR AND A METHOD FOR THE OPERATION OF A SUCH REACTOR

BACKGROUND OF THE INVENTION

This invention concerns fluid-bed combustion reactors and a method for the operation of a fluid-bed combustion reactor. The invention further concerns a fluid-bed cooler for particulate material.

Fluid-bed systems are used in a number of processes, wherein a good contact between solid particulate material and gas is desired. Examples are heat exchange, reactions with heterogeneous catalysts and reactions directly between solid matter and gases. The fluid-bed principle may briefly be explained in that the solid particulates are affected by a fluidization gas introduced from below, it being within certain constraints possible hereby to suspend the particles within a body of particulate materials and keep them suspended, even though the gas flow velocity does not need to rise to a level where single particles except for the very smallest ones would be entrained and carried away by the gas flow. Under such conditions the individual particles are freely movable, but the body of the particulate material will exhibit an upper surface, i.e. it behaves like a liquid from which the name fluid-bed. Hereby, obviously a very large area of contact between the solid particulates and the applied gas is achieved.

Recently fluid-bed systems have acquired a special interest in connection with applications related to combustion systems for solid fuels. Important advantages are that fluid bed systems may operate on various types of fuel and that an extremely good heat transfer from the combustion may be obtained. The body of particles within such systems may comprise inert particles such as sand, into which a minor proportion of fuel is added. The inert particles are heated by the combustion and circulate within the fluid-bed contacting suitable heat exchanger surfaces to transfer heat hereto. Heat transfer by radiation or by gas convection to fixed heat exchanger surfaces which is usual with other combustion systems will thus to some extent be replaced by heat transfer through physical transport of particles, whereby extended contact areas and heat exchange by direct contact between solid matter is obtained, whereby the heat exchange coefficient (number of watts exchanged related to $m^2$'s of surface area and related to degrees of temperature difference) is higher than that achieved by the contact between gas and fixed surface.

Fluid-bed combustion systems allow a closer control of combustion parameters and make it possible to clean the exhaust gas for certain undesirable materials as reactants may simply be intermixed into the bed material, making it possible to achieve a combustion which in several respects is more environmentally acceptable than it is possible with other combustion systems. However, besides these advantages there are also certain difficulties connected to fluid-bed reactors, among which may be noted that they are substantially more complicated than other combustion systems by requiring the controlled introduction of fluidization gas, and by requiring extended start-up periods, e.g. of the magnitude of 3 to 10 hours, due to the substantial amount of solid material to be heated. Furthermore, it is difficult to operate them completely satisfactory by partial load, and adjustments of the load can only be carried out slowly.

Fluid-bed combustion systems are traditionally classified by the mean velocity of fluidization gas upwards through the fluid-bed, several variants occurring operating at various gas velocities within a range that may be generally described by the limits designated slow beds and fast beds, respectively.

Slow beds are characterized by a fluidization velocity typically within the range 1 through 3 m/second, this velocity having lower limits defined by the requirement for oxygen to the combustion and by the requirement for a minimum gas velocity in order to fluidize the particles. The density within the body of particles will be relatively high and the bed must be relatively shallow in order to keep the gas pressure necessary for fluidization within reasonable limits. However, hereby the dwell time for fuel particles and for the gas within the bed becomes too short to ensure a complete combustion, slow beds therefore exhibiting not quite satisfactory combustion efficiency and little possibility for cleaning of the exhaust gas.

Fast beds are characterized by a fluidization velocity within the range of approximately 3 through 12 m/second, whereby a substantial portion of bed particles are entrained by elutriation with the fluidization gas and must be recirculated back to the bed. They are also designated circulating beds and do not exhibit any well-defined bed surface. They may provide a superior combustion and superior exhaust gas cleaning than slow beds, but have the disadvantage of requiring extended systems to separate bed particles from the exhaust gas and recirculate the particles. Another disadvantage related to fast beds is that the heat exchange coefficient between said particles and heat transfer surfaces is inferior at the higher velocities as compared to the velocities typical in the slow beds.

In the past several attempts have been made to devise designs obtaining the consolidated advantages of the slow beds and of the fast beds.

U.S. Pat. No. 4,111,158 to Reh et al. e.g. discloses a fluid-bed reactor with a fast bed, in which combustion takes place, a cyclone to separate the bed particles from the exhaust gas and a fluid-bed cooler, wherein the separated particles are passed through a secondary fluid-bed of the slow type, wherein the particles exchange and dissipate their heat to heat transfer surfaces. The system described is very complicated and extensive, which is considered extremely undesirable, keeping in mind that all conducts and transportation systems must be designed to withstand combustion at temperatures of the magnitude of 800° C.

U.S. Pat. No. 4,788,919 to Holm et al. discloses a more compact solution comprising a central combustion bed with gas inlets at the bottom and optionally with secondary gas inlets located hereabove, from which particles are elutriated and carried up into a top chamber, and with a secondary fluid-bed or a fluid-bed cooler arranged annularly around the central fluid-bed at a level above the central fluid bed so that the particles transported up into the top chamber may drop down into this secondary fluid-bed. In the secondary annular fluid bed, which is a slow bed, particles may dissipate their heat to heat transfer surfaces and the particles may thereafter by means of gravity flow back to return to the central primary fluid bed.

U.S. Pat. No. 4,594,967 to Wolowodiuk discloses a fluid-bed combustion reactor with a primary bed, a top chamber and a fluid-bed particle cooler arranged in such a way that particles entrained with the gas flow from the primary bed may enter the top chamber and drop down to the particulate cooler, wherein the particles pass serpentine tubes and are cooled. From the cooler the particles pass a valve means down to a storage chamber and from the bottom of the storage chamber the particles may pass another valve means to return to the primary fluid-bed. This design is relatively compact, but no possibility is disclosed for varying the relation between the various areas of cooling sections apart from a possibility for partly emptying the particle cooler by conveying particles down into the storage chamber so that a portion of the cooling tubes in the particle cooler will no longer be covered by particles. However, a such method of operation must be considered extremely disadvantageous as the particles serve the purpose of protecting the tubes against the corrosive effects of the exhaust gases and as any portion of tube situated just above the upper surface of the fluidized particles will be subjected to abrasive wear by particles thrown upwards from the fluid bed and hitting the tube with some velocity. The document includes no disclosure regarding the design of the valves for the flow of particles, mentioning only that they may be activated selectively. Thus, no facility for the continuous control or facility for obtaining a constant controlled flow of particles downwards through the particle cooler and returning to the reactor is shown.

The provision of a separate fluid-bed particle cooler is a considerable improvement to fluid bed combustion systems, however, substantial problems remain, which have as yet not been solved quite satisfactorily. The heat transfer systems briefly mentioned in the above patents will e.g. for power generator purposes normally comprise a water preheater, also designated an economizer, an evaporator, in which the water is evaporated, and a super-heater, in which steam is super-heated. These heat transfer systems operate at different temperatures and must therefore be arranged paying regard to heat energy transfer requirements and applicable temperatures. Another factor that must also be taken into account is that the heat transfer systems also serve the purpose of protecting the constructional elements against the elevated temperatures. In practical fluid-bed combustion systems the greater part of the walls must therefore be provided with heat transfer systems. The economizer, which operates at a relatively low temperature, is preferably arranged in the exhaust gas duct after other heat exchangers. The super-heater operating at the highest temperature, e.g. 500° to 530° C., is conveniently arranged with a greater portion within the fluid bed, where the good heat transfer coefficient for the particles and the heat transfer surfaces make possible the heating to the high temperatures and with a smaller portion in the exhaust gas duct. It is noted that by the greater and smaller portion is understood portions with greater and smaller heat power transfer rather than geometrically greater and smaller portions. Within the fluid-bed particle cooler the super-heater may also to some extent be protected against corrosion and erosion, which is a critical factor at the elevated temperatures.

Evaporator tubes are conveniently utilized for cooling the walls, but since typically the area of evaporator surfaces needed exceeds what can be integrated into the walls, further sections of evaporator tubes are arranged within the fluid-bed cooler or in the exhaust gas duct before the economizer, or sections of evaporator tubes may be arranged in all of these places. The areas of the various heat transfer surfaces are naturally fixed once the reactor has been built.

However, the optimal relation between the areas of the various heat transfer surfaces depend upon the type of fuel used. E.g. fuels developing a relatively large proportion of water or steam in the exhaust gas ideally need a relatively smaller evaporator surface area than it is the case by combustion of coal. Fuels developing a larger proportion of water or steam could e.g. be fuels actually containing water such as particles of coal suspended in water or fuels which due to a content of hydrogen develop water by the combustion such as is the case with straw or wood. In case a plant designed for the optimal combustion of coal is to burn straw, the water-flow through the heat transfer surfaces must be reduced, but hereby the temperature in the evaporator sections may rise unacceptably. Similar problems may arise by partial load. To operate at partial load the air flow is reduced while the temperature within the reactor is kept substantially unchanged. The heat radiated onto the reactor walls which is ultimately transferred into the evaporator tubes arranged within the walls is therefore not reduced very much and the temperatures within the evaporator tubes may therefore tend to increase by the reduced water flow. The opposite problem might however, depending upon the particular circumstances, also occur, i.e. the temperature of the super-heater tubes could increase too much by a load reduction, in particular in case the heat transfer surfaces are arranged partly in the exhaust gas duct and partly within the fluid-bed cooler. By partial loads the gas-flow for fluidization is reduced, but hereby the heat transfer from the exhaust gases drops much more than the heat transfer within the fluid-bed. As mentioned above the super-heater surfaces are often arranged for the greater portion within the fluid-bed, and in case a substantial portion of the evaporator surfaces is arranged in the exhaust gas flow the super-heater temperature may rise too much due to the reduction of the water-flow. It is here noted that the temperature within the fluid-bed and therefore within the combustion chamber should be kept within a narrow range for satisfactory operation of the fluid-beds at full load as well as at partial loads. The strategy practically adhered to in the prior art is the adding of water at suitable points between sections of the evaporator tubes and before the super-heater in order to ensure that the tube temperature is kept within safe limits, which, however, does not provide the best economy of the system.

A further reason for inferior efficiency by systems of the prior art operating at partial load is that the amount of particulate matter in the reactor may not be optimal. By partial load the fluidization velocity will be reduced and the density of the bed will therefore be increased. In order to obtain a predetermined level of the beds the amount of particulate matter must therefore also be altered.

BRIEF SUMMARY OF THE INVENTION

The object of the invention is to solve the above drawbacks of the fluid-bed reactors of the prior art.

A further object of the invention is to provide a fluid-bed combustion reactor operating with better energy efficiency than comparable reactors of the prior art.

A still further object of the invention is to provide a fluid-bed combustion reactor capable of operating efficiently over a wider load range than possible with comparable reactors of the prior art.

These objects are achieved by the fluid-bed cooler and a method of operating a fluid-bed combustion reactor as described below.

The sectionalization according to the invention is in essence defined by the sections or regions within the particle cooler vessel, within which fluidization gas is introduced. The various sections of the fluid-bed cooler do not need to be divided by physical partition walls. In the case the sections are not delimited by physical partition walls, boundary regions may exist which cannot clearly be referred to one of the sections. However, still the various sections may be operated in modes which are individually controllable, notwithstanding the fact that the boundaries may not be sharply defined.

The invention utilizes the discovery that the heat transfer may advantageously be controlled by the control of the fluidization gas velocity. The heat transfer coefficient for contact between the fluidized particles and the heat transfer surfaces depends upon the fluidization gas velocity in a way which may be explained in that this coefficient rises from a certain initial value by zero fluidization and climbs to a maximum at a given velocity of fluidization, which velocity sometimes is referred to as the optimal fluidization velocity, whereafter the coefficient slowly declines by further increase of the fluidization gas velocity.

The heat-transfer tubes are according to the invention divided into sections corresponding to the sections of fluidization. It is advantageous to operate every one of the tube sections at a substantially uniform load over each length of tube, and in particular to avoid temperature steps along the length of a tube. By using the sectionalization in such way that the super-heater is arranged within one section and the evaporator within another section the amount of heat transferred may be controlled individually for each of these sections by control of the fluidization gas velocity, whereby optimal conditions for the heat transfer may be achieved in all operating modes including operating at partial loads and operating with various types of fuel.

The flow of fluidization gas should, though, always be kept above a limit defined by the onset of fluidization. The fluidization induces a continuous agitation and mixing of the particles within the cooler, so that the particle discharge opening may be arranged practically anywhere in the cooler bottom wall.

A preferred embodiment of the invention provides, though, for the arrangement of at least one particle discharge opening within each section and for particle discharge flow control means associated with each of said openings.

According to a further preferred embodiment the sections are divided by a boundary region, which is not fluidized.

This provides for a physical separation between the sections by creating a "wall" of non-fluidized particle material so as to minimize or completely avoid intermixing between the sections, whereby the heat transfer within each section may be controlled substantially independently of the operating mode in the adjacent section. E.g. the heat transfer within one section may be reduced substantially by reducing the fluidization gas velocity within this section to the minimum, where the gas is just capable to fluidize the particles. During normal operation heated particle material will drop all over the fluid-bed cooler and the level of the particles in this section will build up until the "wall" will start to slide slowly and uniformly sideways towards the adjacent section, in which the level of particles is lower, so that the particles transferred from the first section will transfer heat to the tubes arranged therein. It is understood that substantially different modes of operation may be selected by simple control of valves, e.g. a first mode of operation, where the particles dropped onto the cooler move uniformly, i.e. parallel down over two sections of the cooler, a second mode of operation, where a portion of the particles moves serially from a first section to a second section and a third mode of operation, where a portion of the particles moves serially from a second section to a first section.

According to another preferred embodiment of the invention the fluid-bed cooler is divided into three sections, wherein a first-section accomodates evaporator tubes, a second section accomodates super-heater tubes and a third section provides storage for particles, but no cooling surfaces. Hereby a very simple storage facility for portions of the particles is provided so that the amount of particles actively used within the fluid-bed reactor may be adjusted providing an added facility for optimizing the amount of particles for the prevailing conditions of operation. Furthermore, it becomes possible to recirculate particles through the storage section and back to the primary fluid-bed without cooling, which is advantageous during start-up in order to achieve the operating temperature within the particles as quickly as possible and also advantageous in the cases where the amount of particles necessary for the combustion exceeds the amount of particles desired passed along the heat transfer surfaces.

The invention further provides a method for the operation of a fluid-bed reactor equivalent to the operation of the reactor described above, which method is defined in patent claim 16. By this method advantages equivalent to what is described above are achieved.

BRIEF DESCRIPTION OF THE DRAWINGS

Further objects, features and advantages of the invention will appear from the following description of preferred embodiments with reference to the accompanying drawings, wherein.

DETAILED DESCRIPTION

Figure 1:
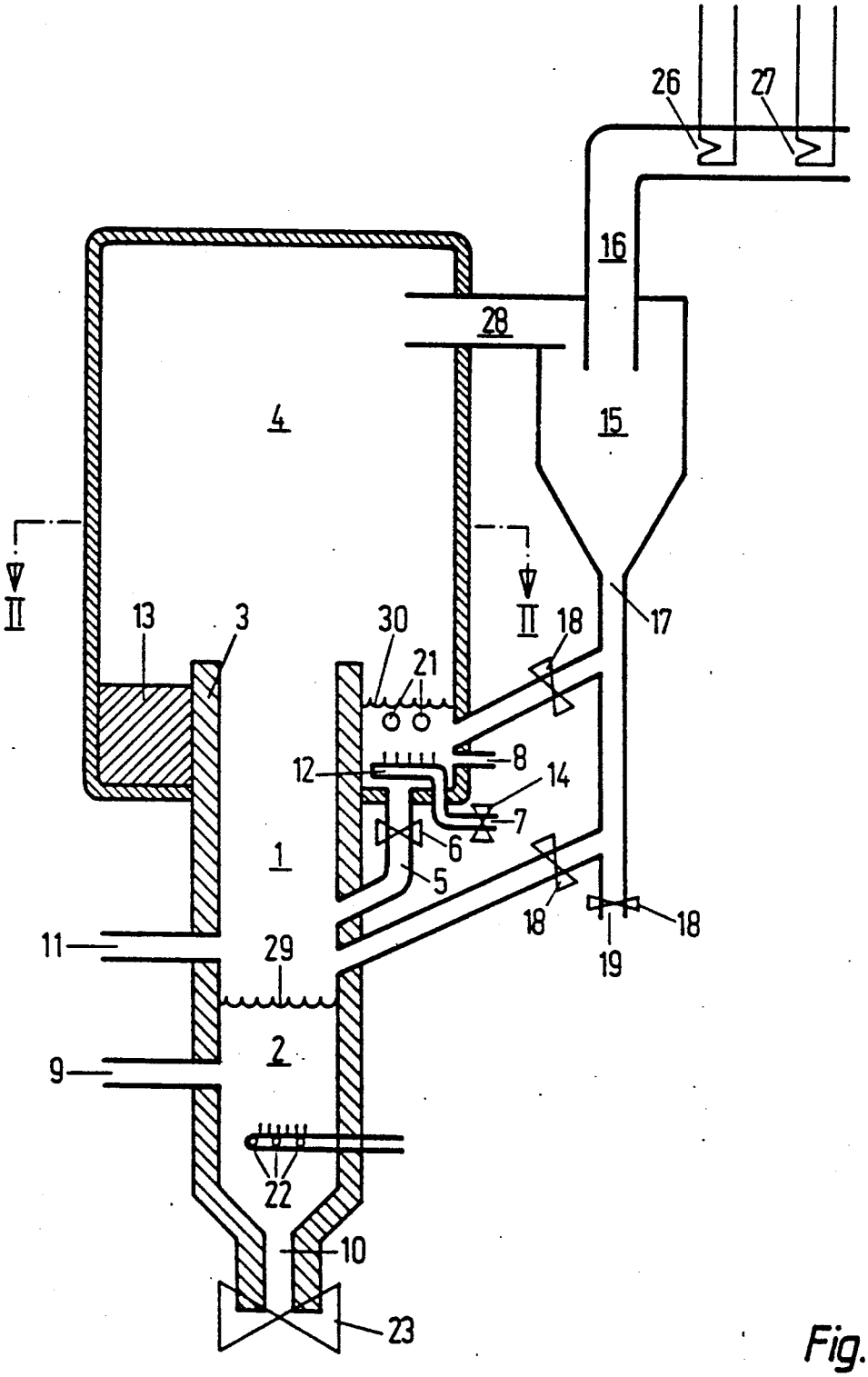
FIG. 1 is a schematic vertical cross sectional view through a fluid-bed reactor according to the invention.

Throughout the drawings equivalent or similar features are indicated by the same reference numerals.

Reference is first made to FIG. 1, showing a reactor 1 comprising a bottom chamber 2 surrounded by a wall 3 and provided above with a top chamber 4. The bottom chamber 2 is at its lower end provided with an outlet 10 with a valve mechanism 23 so that particles may be discharged if necessary. At a predetermined distance above the outlet 10 a manifold 22, tuyere or a plenum chamber with jets for the introduction of air or gas for fluidization is arranged. In the region below the manifold 22 the particles will be unfluidized unless other means for fluidization are provided here, but the particles may slide downwards by the effect of gravity towards the outlet 10 when the valve mechanism 23 is opened. Particulate material, which may comprise fuel, inert particles such as said suitable reactants for binding of undesired matter, etc. are introduced through the inlet 9. Further inlets 11 for secondary reactor air may optionally be provided, whereby a slow fluid-bed may be maintained at the reactor bottom, while a faster fluid-bed is maintained above the secondary air inlet. Solid particles are elutriated by the air flow and entrained upwards into the top chamber, in which the air velocity drops because of the larger cross-sectional area of the top chamber, whereby particles move out towards the sides and may drop down there. The top chamber is provided with an exhaust duct 28 for flue gas, which duct may be provided with deflectors or baffles (not shown) in order to reduce the amount of particles carried out with the flue gas. The exhaust duct 28 may optionally lead through a cyclone 15 for further separation of solid particles from the flue gas. The flue gas exits the cyclone 15 through the duct 16, while the solid particles exit the cyclone at the cyclone bottom 17 and are carried through ducts 20 back to the fluid-bed reactor at suitable positions. The cyclone may be provided with a lower outlet 19, from which particles may be taken away from the fluid-bed circulation, and all particle outlets from the cyclone are provided with control valves 18 to allow full control of the particle flow. Particulate material carried up from the primary fluid-bed 29 and into the top chamber will for the greater part drop adjacent the sides and thereby drop onto the secondary fluid-bed 30 or fluid-bed cooler surrounding the primary bed 29 wall 3. Particulate material within the secondary fluid-bed 30 is fluidized by blowing of gas or air through an air plenum chamber with jets 12. The secondary fluid-bed is provided with heat transfer tubes 21 for cooling particulate material. Particulates may flow from the secondary fluid-bed and downwards through ducts or downcomers 5 past control valves 6 to return to the primary fluid-bed. The secondary fluid-bed may be provided with inlets 8 for the introduction of suitable reactants. Heat in the flue gas leaving the cyclone is also recovered by passing the flue gas past further heat transfer surfaces, e.g. an evaporator 26 and a preheater or economizer 27.

Figure 2:
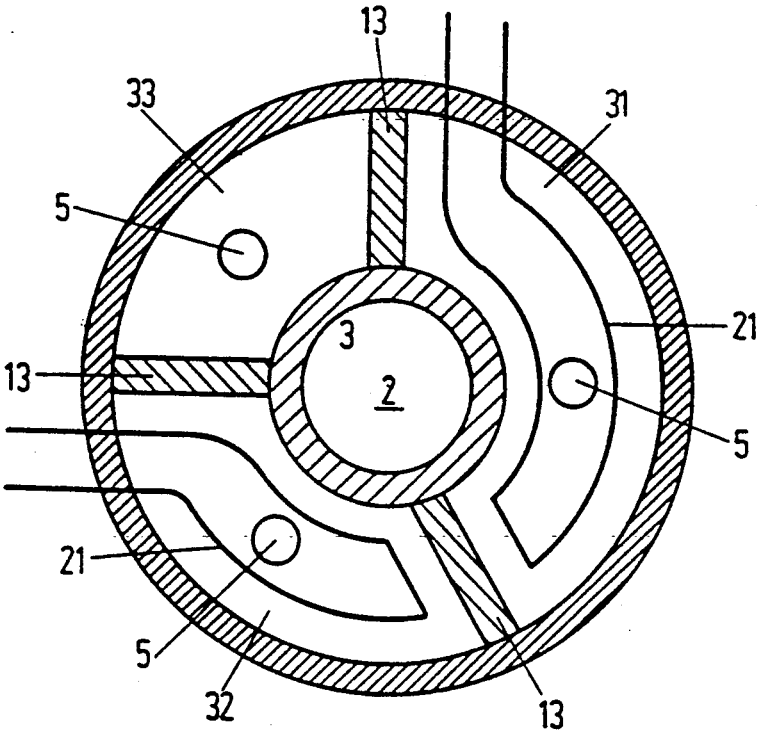
FIG. 2 shows a horizontal cross-sectional view taken along the line II—II of FIG. 1.

Reference is now made to FIG. 2, showing a horizontal section through the reactor along the line II—II of FIG. 1, showing how the secondary bed or the bed cooler 30 is divided into three sections 31, 32 and 33 designated the evaporator section 31, the super-heater section 32 and the storage section 33, respectively. The sections are advantageously separated by radial partition walls 13, each section being provided with a downcomer 5 for returning particles to the primary bed. The figure shows heat transfer tubes 21 in the evaporator section and in the super-heater section. All three of the sections are provided with fluidization gas jets, but it is optionally possible to dispense with fluidization jets in the storage section, in which case the particle material moves down to the downcomer by the force of gravity.

As it may be seen at the left-hand portion of FIG. 1 the partition walls 13 between the sections of the fluid-bed cooler have a top edge at a level lower than that of the wall 3 separating the cooler from the primary reactor in order to make it possible for particles to flow over a partitioning wall 13 into an adjacent section.

In a practical embodiment of the fluid-bed cooler the evaporator section extends over 150 angular degrees, the super-heater over 120 degrees and the storage section over 90 degrees, but obviously these sizes and forms could be modified in numerous ways.

The advantages gained through the facilities allowing various modes of operation may be understood from the following explanation. Supposing the reactor is to operate on partial load, the amount of particles actively circulated must be relatively large due to the higher density of the beds. This is achieved very simply by reducing the amount of particles in the storage section, i.e. the control valve 6 for the downcomer 5 from the storage section will be fully opened and the control valve 14 for fluidization gas into the storage section is also fully opened in order to keep the density within the storage section of the secondary bed as low as possible. The particles in the evaporator section and in the super-heater section are fluidized with a flow of fluidization gas, which is kept to the minimum determined by the request for obtaining sufficient heat transfer. This is possible by fluidization velocities as low as 5 cm per second for a mean particle diameter in the order of 160 μm. In order to avoid erosion and corrosion the amount of particles within the evaporator section and in the super-heater section is kept sufficient to cover the heat transfer surfaces completely. A fine tuning of the heat transfer within each of the cooling sections is possible by the control of the particle flow and the control of the fluidization gas velocity.

Supposing alternatively that the reactor is operating at full load, the density of the particles within the fluid-beds is lower and the amount of particles actively circulated must therefore also be lower in order to obtain the optimum combustion efficiency. This is obtained by closing or partially closing the outlet valve 6 from the storage section and also closing or partially closing the control valve 14 for introduction of fluidization gas to this section so that the amount of particles within the storage section is increased with particles taken away from active circulation in the reactor to the extent necessary. It is obvious that a superior efficiency of the combustion may be obtained when operating at full load as well as when operating at partial load and that the reactor may operate efficiently at a lower load factor than economically feasible with fluid-bed reactors of the prior art.

The flow control facility and the facility for removing portions of the particles from the active circulation respectively to reintroduce them furthermore makes it possible to carry out the start-up or adjustments of the load at a faster rate than possible with reactors of the prior art.

Figure 3:
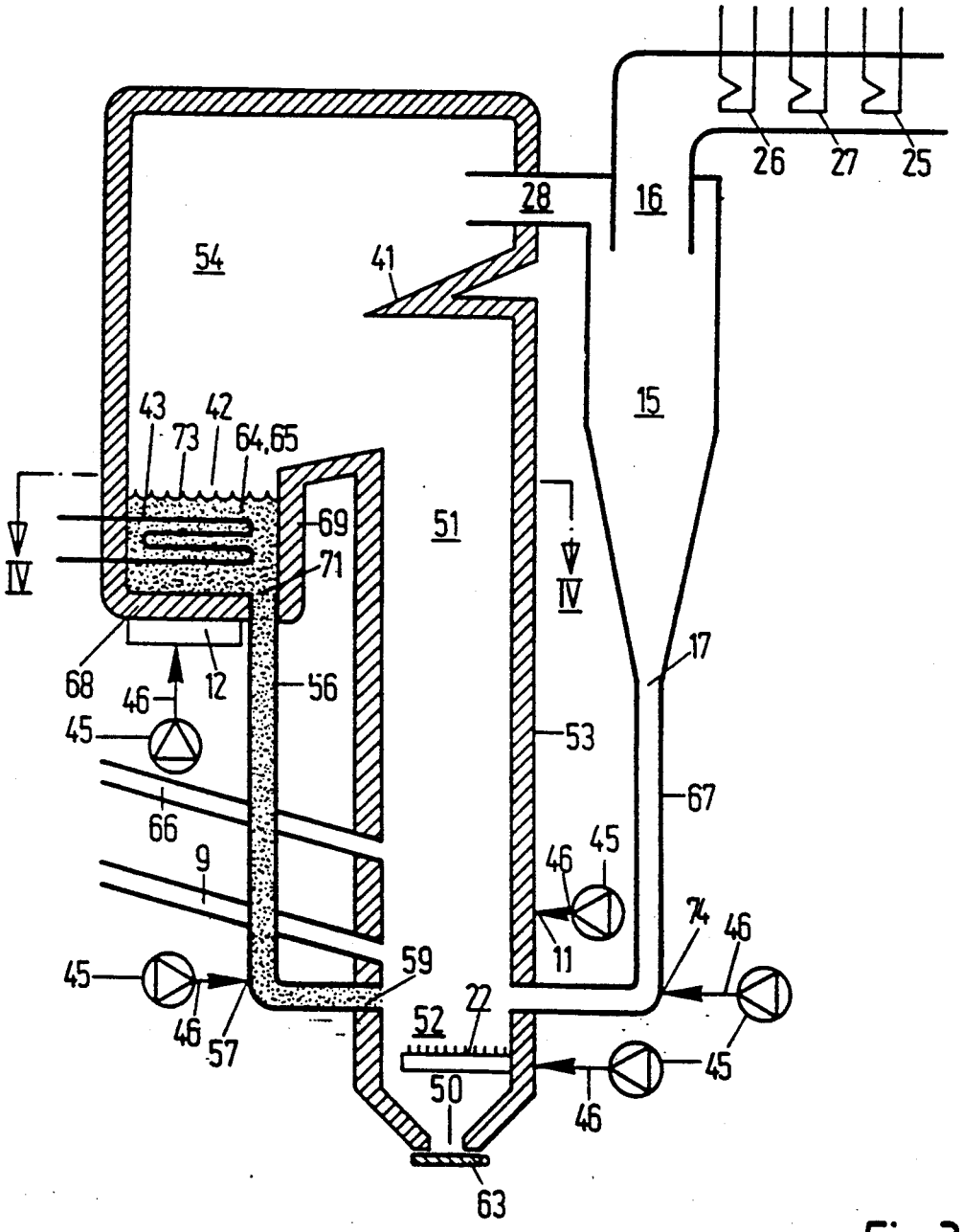
FIG. 3 is a view similar to FIG. 1 showing another preferred embodiment of the invention.

Reference is now made to FIG. 3, showing a vertical section through a fluid-bed combustion reactor according to a preferred embodiment of the invention. This reactor 51 comprises as shown in the figure a bottom chamber 52 defined by a wall 53 and with a top chamber 54 arranged thereabove. The bottom chamber 52 is at the lower end provided with a discharge opening 50 with a valve mechanism 63 to allow removal of particle matters and ashes if necessary.

At a predetermined distance above the bottom outlet opening 50 a manifold or a plenum chamber 22 with jets for the introduction of fluidization air or fluidization gas is arranged. At the area below the manifold 22 the particles will not be fluidized unless other fluidization means are provided here, but the particles may slide downwards to the discharge opening 50 when the valve mechanism 63 is opened.

Similarly to the reactor of FIG. 1 the FIG. 3 reactor 51 is also provided with inlet ducts 9 for the introduction of particles, which may comprise fuel, inert particles, suitable reactants for the binding of undesired matter etc. Further inlets 11 for secondary reactor air may be arranged in order to allow the maintaining of a slow fluid-bed at the bottom, while a faster fluid-bed is maintained above the secondary air inlets similarly to the design of the FIG. 1 embodiment. Above the inlet 11 for secondary reactor air a further upper inlet 66 for the introduction of particulate material such as fuel, inert particles, suitable reactants for the binding of undesired matter etc. may be arranged as it may be advantageous to have the possibility of selecting between various levels of introduction of such particles.

The fluidization jets are provided with air from blowers, each blower being provided with means to control the blow power and each designated with the reference numeral 45. At sufficient power of introduction of fluidization air solid particles will be suspended by the gas flow and entrained by elutriation to arrive at the top chamber, where the flow is deflected sidewards by a deflector 41. The top chamber 54 has a larger cross-sectional area than the reactor lower portion 52 and the gas velocity will therefore decrease in the top chamber. The gas may flow around the deflector 41 to enter the exhaust duct 28 for flue gas. Due to the decreasing gas velocity in the top chamber and due to the change of flow direction a substantial proportion of the particulate material entrained with the gas will drop down into the particulate cooler 42 arranged below the top chamber.

Exhaust gas will exit through the exhaust duct 28 to arrive at the cyclone 15, where further separation of solid particles from the exhaust gas takes place. Gas exits the cyclone 15 through the duct 16 and flows past further cooling surfaces, e.g. evaporator tubes 26, a pre-heater or economizer 27 and an air pre-heater 25. Particles separated from the exhaust gas in the cyclone 15 exits the cyclone at the bottom 17 and may move downwards through the downcomer 67 from the cyclone to be reintroduced into the primary reactor 51.

Particles dropped down into the particle cooler 42 may move downwards herein in a way to be explained in more detail below and flow through a downcomer 56 returning the particles for reintroduction into the primary reactor 53. As shown in FIG. 3 the particle cooler is provided with a controllable blower 45 blowing fluidization air through conduits 46 upwards through the particle cooler through fluidization jets 60 in order to fluidize the bulk of particles in the particle cooler 42. The upper surface of the bulk of particles in the particle cooler is shown at 73.

Figure 4:
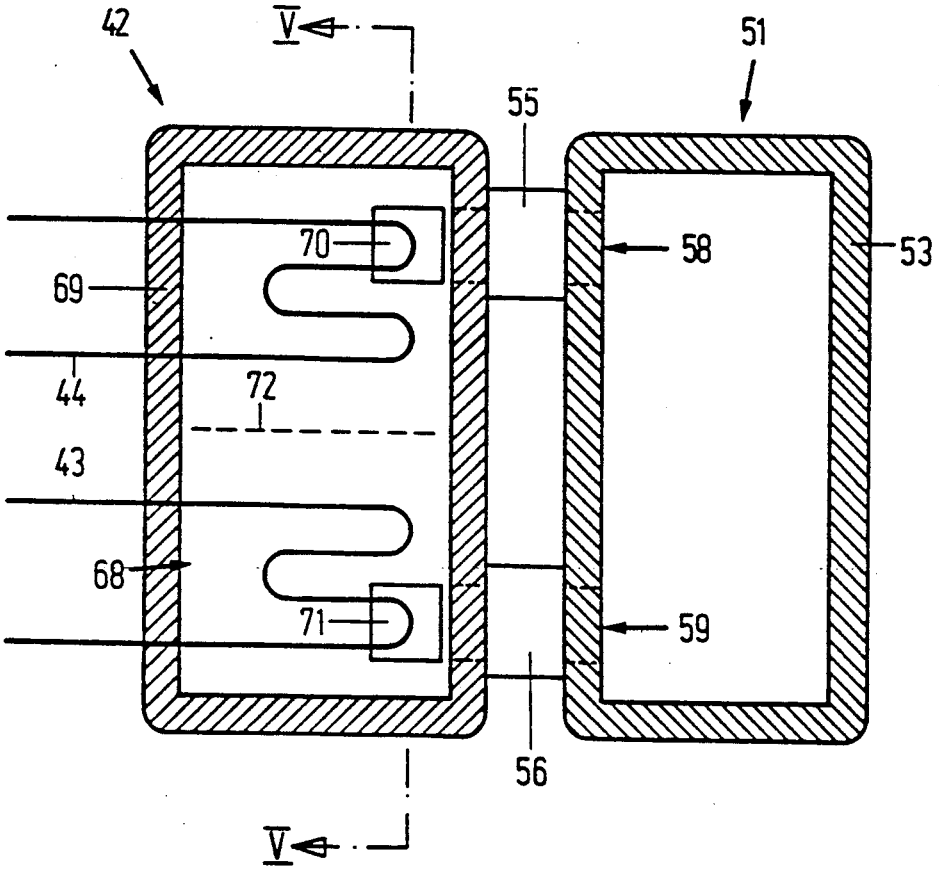
FIG. 4 is a horizontal cross-sectional view taken along the line IV—IV of FIG. 3.

Reference is now made to FIG. 4, showing a plan sectional view through the reactor along the line IV—IV of FIG. 3. As may be seen from FIG. 4 the reactor is substantially rectangular and the particle cooler 42 is also substantially rectangular and arranged adjacent the reactor sides and with one side parallel to the side of the reactor. The particle cooler comprises bottom wall 68 and side walls 69. As shown in the figure the particle cooler is provided with coolant tubes in a serpentine pattern sectionalized into two sections, said sections being designated the evaporator tube coil 43 and the super-heater tube coil 44. These tube coils carry water and/or steam and the flow within each of the tube coils may be controlled separately. In the particle cooler 42 bottom 68 openings 70, 71 are provided for particle discharge. The opening 70 takes the particles down through a downcomer 55 from the super-heater section, while the opening 71 carries particles down through downcomer 56 from the evaporator section. The demarcation line between the two sections within the particle cooler 42 is indicated by a dashed line 72. As indicated in phantom both downcomers communicate with the reactor so that particles from both downcomers may be reintroduced into the reactor.

In FIG. 3 only one of the downcomers, i.e. the evaporator section downcomer 56, is shown shaped as an L with a relatively tall vertical portion and a relatively short horizontal portion at the lower end. The super-heater section downcomer 55 is similarly formed. As it may be seen in FIG. 3 an air jet 57 connected to a blower 45 with a blower control facility by a conduit 46 is arranged at the downcomer lower end. During normal operation the downcomer will be filled with particles up to a level above the coolant tube coils in the particle cooler. Blowing of air through the jet 57 will carry particles through the downcomer horizontal portion and into the reactor as the resistance to the air-blowing is lower this way. The pressure in the pillar of particles within the downcomer is normally so high that these particles will not be fluidized, but rather slide downwards slowly by gravity in proportion to the amount removed at the bottom. The inventor has found it possible by the controlled blowing of air through the air jet 57 to control the flow of particle material into the reactor in a very convenient way so that the arrangement with the jet 57 may be regarded as a type of valve controlling the particle return flow into the reactor.

It is understood that the other downcomer from the particle cooler 56 connected with the super-heater section is provided with a similar air jet 47 (cf. FIG. 5 and FIG. 6) and operates in a similar fashion so that reference may be made to the above description. Furthermore, the particle return conduit from the cyclone is similarly provided with an air-jet 74 and with a controllable blower 45 through corresponding air-conduits 46 so that the particle flow from the cyclone bottom returning to the reactor may be controlled in a similar fashion.

Figure 5:
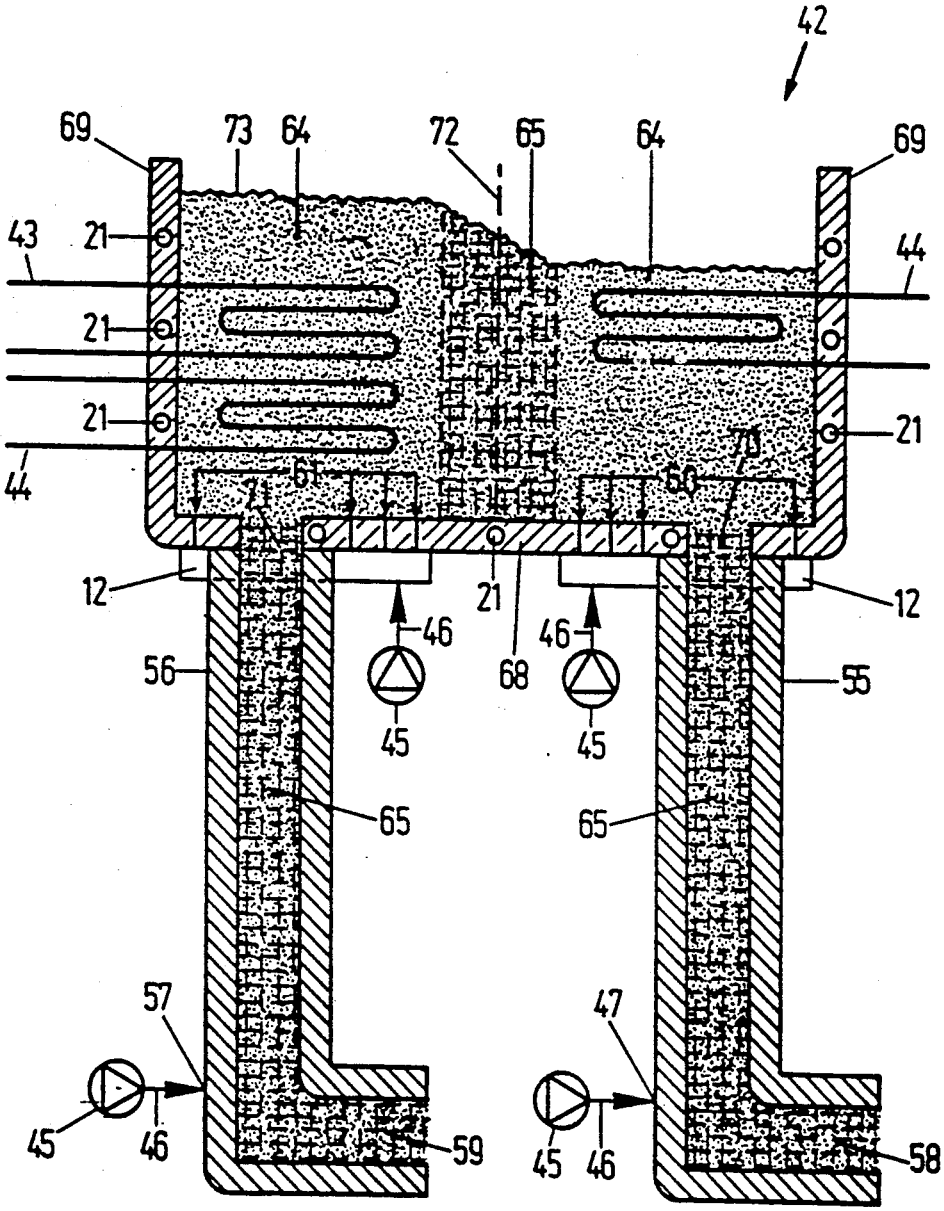
FIG. 5 is a vertical and partially schematic cross-sectional view of a cooler for particles according to another preferred embodiment of the invention.

Reference is now made to FIG. 5, showing a vertical section through a particle cooler 42 with a super-heater section downcomer 55, an evaporator section downcomer 56, air-jets for the super-heater section downcomer 56 and air-jets for the evaporator section downcomer 57. In order to make the figure easily understandable the horizontal portions at the lower end of the downcomers are illustrated as extending sidewards in FIG. 5 and in FIG. 6, although these horizontal sections actually extend perpendicularly to the plane of the drawings in FIG. 5 and 6 as it may be understood by referring to FIG. 4.

FIG. 5 shows a section through the particle cooler bottom wall 68 and side walls 69 with integrated coolant tubes 21, which allows the temperature within the wall elements to remain within acceptable limits. The figure further shows the serpentine-like evaporator tube coil 43 and two serpentine-like super-heater tube coils 44, a first one of them arranged in the right-hand portion of the cooler as shown in FIG. 5, and a second one of them arranged in the left-hand portion of the cooler underneath the evaporator tube coil 43. For reasons of simplicity the sections of the particle cooler will be referred to as the superheater section and the evaporator section, although the evaporator section contains also a super-heater tube coil. Below the particle cooler bottom 68 blowers 45 with air conduits 46 connected with the super-heater section fluidization jets 60 and the evaporator section fluidization jets 61, respectively, are shown. By providing two blowers in this fashion the fluidization within the two sections may be controlled separately as the inventor has discovered that the fluidization gas flows essentially vertically upwards through the bulk of particles. The fluidization jets are shown symbolically in the figure as the real cooler is provided with a large number of jets arranged with close spacings all over the cooler bottom except for a region along the midst, i.e. along the section line 72 of demarcation, where the fluidization jets are omitted.

FIG. 5 shows fluidized particle areas 64, while there is a portion of particles 65, which is not fluidized. It is understood, referring also to FIG. 3 and FIG. 4, that the particle cooler during normal reactor operation receives a continuous flow of heated particles spread substantially all over the particle cooler 42 surface. FIG. 1 illustrates a mode of operation, where the levels of the particle matter within the two sections of the particle cooler 42 are not equal. This may be the case in a mode of operation where more air is blown through the air jet 47 into the super-heater section downcomer 56 than blown through the air-jet 57 into the evaporator section downcomer 56. Hereby a greater amount of particles are removed from the super-heater section. The difference between the levels of particles makes the "wall" of unfluidized particulate material 65 slide slowly towards the right in the figure, whereby naturally particles of the wall will gradually be fluidized as they move into a region over fluidization jets. Within each of the sections the fluidization gas provides agitation and circulation of the particles, whereas the wall of unfluidized particles 65 between the sections keeps them separated so that an unidirectional gradual and controlled flow across the line of demarcation is achieved, e.g. a net transfer of particles and thus of heat from one section to another. In the mode of operation illustrated the particle flow around the evaporator tube coils will be low so that the heat transfer to the evaporator tubes will be low, whereas the particle flow around the super-heater tube coils is high so that the heat transfer to super-heater tubes is higher. In order to achieve an even larger difference in the heat transfer rates the inflow of fluidization gas into the super-heater section through the air jet 60 may be increased to agitate the particles within this section more. The inflow of fluidization gas through the evaporator section jet 61 is decreased to a level where the gas flow just fluidizes the particles within the section. At this flow level the coefficient of heat transfer to the evaporator tubes is low causing an even further decrease in the heat-energy transferred to the evaporator tubes.

It is obvious from FIG. 5 and from the above given explanation that other modes of operation equally well could be selected, e.g. a mode where a greater heat transfer into the evaporator tubes takes place or a mode of operation with equal flow in the two sections and equal heat transfer rates.

Figure 6:
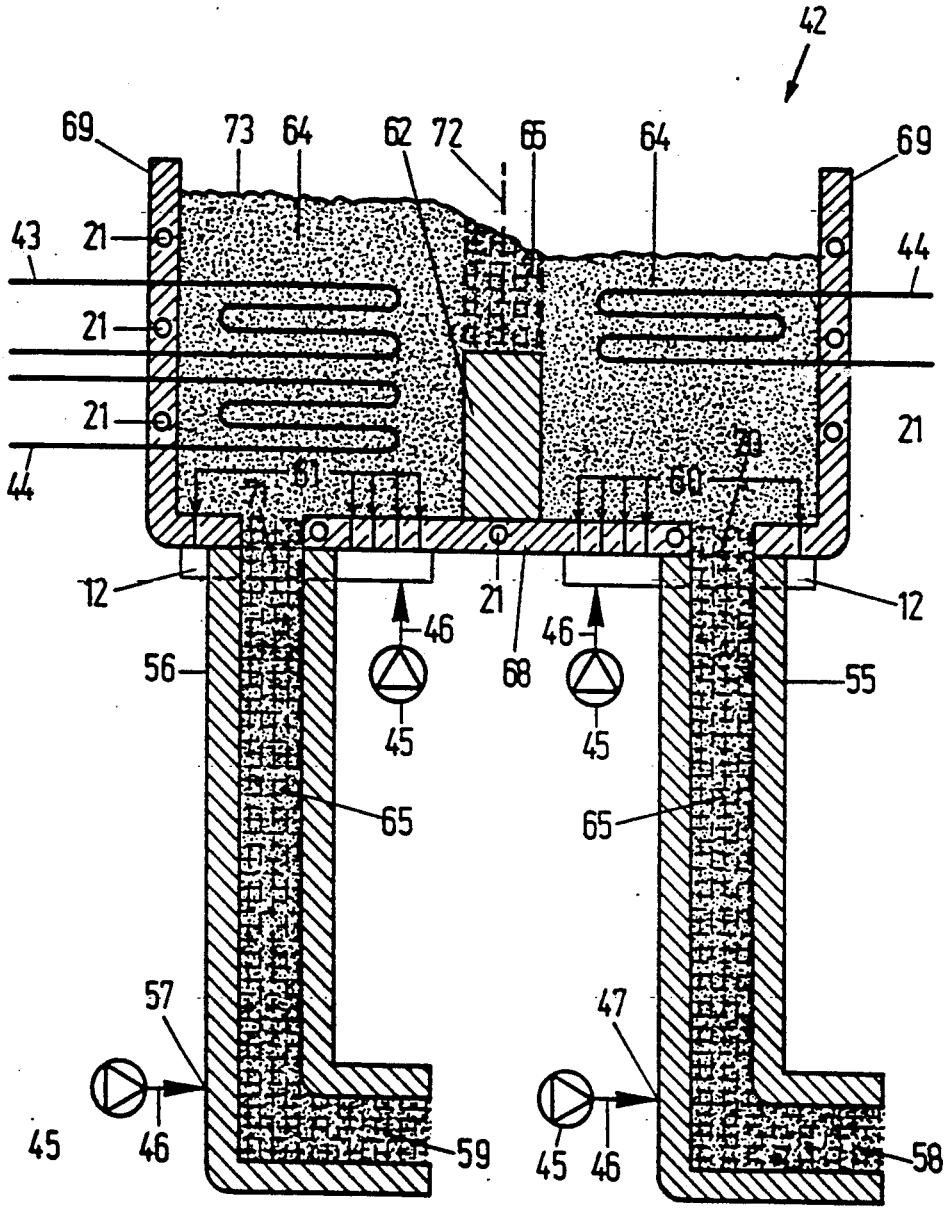
FIG. 6 is a view similar to FIG. 5, but showing af modified embodiment of a further the cooler for particles according to the invention.

Reference is now made to FIG. 6, showing another preferred embodiment of the particle cooler according to the invention. Most of the parts in the FIG. 6 embodiment are identical to those of the FIG. 5 embodiment, but the embodiment of FIG. 6 is provided with a section partition wall 62 along the section line 72 of demarcation. This section partition wall 62 is low compared to the cooler side walls so that particles may flow over the partition wall 62 in case the levels differ so as to provoke such flow. Obviously, the region above this section partition wall will contain unfluidized particles 65. All other elements of the embodiment in FIG. 6 are equivalent to those in FIG. 5 so that reference may be made to the above-given explanation. It is understood that the embodiment of FIG. 6 provides for a very distinct separation of the two sections whereby the heat exchange between the particles of the two sections is reduced.

Although different embodiments of the invention have been illustrated and described in detail, the invention is not to be considered as limited to the precise constructions and embodiments disclosed and various adaptations, modifications and uses of the invention, which may occur to those skilled in the art, to which the invention relates, may be made without departing from the spirit and scope of the invention.

I claim:

1. A fluid-bed cooler for particular material comprising:

a vessel having upwardly extending side walls, a substantially closed bottom and an open top;

particulate material in said vessel;

at least one opening in said bottom for discharge of said particulate material in said vessel;

heat transfer means in said vessel comprised of at least two separate heat transfer sections, each section comprising a heat transfer tube means conducting a heat transfer medium on the inside thereof and contacting particulate material flowing on the outside thereof;

a boundary region between said heat transfer sections wherein the particulate material is not fluidized;

inlets at said bottom for introduction of gas into said vessel for fluidization of particulate material in said vessel, said inlets comprising separate sections of inlets corresponding to said at least two heat transfer sections; and separate control means for controlling the flow of fluidizing gas into said vessel through each separate fluidizing gas inlet section.

2. A fluid-bed cooler for particulate material comprising:

a vessel having upwardly extending side walls, a substantially closed bottom and an open top;

particulate material in said vessel;

heat transfer means in said vessel comprised of at least three separate heat transfer sections, heat transfer tube means in two of said heat transfer sections for conducting a heat transfer medium on the inside thereof and contacting particulate material flowing on the outside thereof, no heat transfer tube means being provided in the third heat transfer section;

inlets at said bottom of said vessel for introduction of gas into each heat transfer section for fluidization of particulate material in said vessel, said inlets comprising separate sections of inlets corresponding to said at least three heat transfer sections;

separate control means for controlling the flow of fluidizing gas into said vessel through each separate fluidizing gas inlet section; and an opening in said bottom for each heat transfer section for discharge of said particulate material in said vessel.

3. A cooler as claimed in claim 2 and further comprising:

cooling tubes in at least one of said bottom of said vessel and said side walls.

4. A fluid-bed cooler for particulate material comprising:

a vessel having upwardly extending side walls, a substantially closed bottom and an open top;

particulate material in said vessel;

at least one opening in said bottom for discharge of said particulate material in said vessel;

heat transfer means in said vessel comprised of at least two separate heat transfer sections, each section comprising a heat transfer tube means conducting a heat transfer medium on the inside thereof and contacting particulate material flowing on the outside thereof;

a partitioning wall arranged between said heat transfer sections, said wall having a top edge at a lower level than the top edge of the vessel side walls, so that particulate material may flow over the partitioning wall top edge from one heat transfer section to an adjacent heat transfer section;

inlets at said bottom for introduction of gas into said vessel for fluidization of particulate material in said vessel, said inlets comprising separate sections of inlets corresponding to said at least two heat transfer sections; and separate control means for controlling the flow of fluidizing gas into said vessel through each separate fluidizing gas inlet section.

5. A fluid-bed combustion reactor comprising:

a substantially vertical reactor chamber having an upper portion and a lower portion;

a first inlet in said lower portion for the introduction of at least one of liquid and solid particulate material;

a second inlet at a level below said first inlet for the introduction of fluidizing gas for fluidization of particulate material within the reactor to maintain a primary fluid bed;

an exhaust duct at said upper portion for exhausting gas and particulate material from the reactor; and a fluid-bed cooler for particulate material comprising:

a vessel having side walls, a substantially closed bottom wall, and an open top positioned relatively to said reactor chamber to collect a portion of particulate material in said vessel from said upper portion of the reactor chamber, heat transfer means in said vessel comprising of at least two separate heat transfer sections, each section comprising a heat transfer tube means conducting a heat transfer medium on the inside thereof and contacting particulate material flowing on the outside thereof;

inlets at said bottom wall for introduction of gas into said vessel for fluidization of particulate material in said vessel, said inlets comprising separate sections of inlets corresponding to said at least two heat transfer sections, and separate control means for controlling the flow of fluidizing gas into said vessel through each separate fluidizing gas inlet section.

6. A reactor as claimed in claim 5 wherein:

at least one particle discharge opening is provided in the bottom of said vessel for each separate heat transfer section; and each discharge opening is provided with means for control of the particle discharge flow therethrough.

7. A reactor as claimed in claim 5 and further comprising:

a region between said heat transfer sections wherein he particulate material is not fluidized.

8. A reactor as claimed in claim 6 and further comprising a partitioning wall in said cooler arranged between said heat transfer sections, said wall having a top edge at a lower level than the top edge of the cooler vessel side walls, so that particulate material may flow over the partitioning wall top edge from one heat transfer section to an adjacent heat transfer section.

9. A reactor as claimed in claim 5 wherein:

three heat transfer sections are provided in said vessel;

each heat transfer section is provided with inlets at said bottom of the vessel for the introduction of fluidization gas and with an opening for discharge of particulate material at said bottom;

two of said heat transfer sections are provided with said heat transfer tube means; and no heat transfer tube means is provided in the third section.

10. A reactor as claimed in claim 9, and further comprising:

cooling tubes in at least one of said bottom of said vessel and said side walls.

11. A reactor as claimed in claim 5 wherein:

said at least one opening for discharge of particulate material from the cooler communicates with a return duct through which particulate material may move by force of gravity only, and said return duct has a lower end communicating with the reactor chamber; and means are provided near said lower end for the controlled blowing of gas into said return duct.

12. A reactor as claimed in claim 5 wherein:

said reactor chamber is substantially rectangular in cross-section;

said particulate cooler is substantially rectangular in cross-section; and said cooler is arranged adjacent to and on one side of the reactor and has a side parallel to one of the sides of said reactor chamber.

13. A reactor as claimed in claim 5 wherein:

said reactor chamber is substantially circular in cross-section;

said particulate cooler is substantially annular and surrounds the reactor chamber; and demarcation lines between said heat transfer sections within the particulate cooler extend substantially radially to the reactor chamber.

14. A fluidized-bed combustion process comprising:

providing a fluidized-bed combustion reactor having a lower portion and an upper portion;

introducing particulate material into said lower portion of said reactor;

introducing fluidization gas into said lower portion of said reactor in a manner and at a velocity for entraining a portion of said particulate material therewith and carrying said entrained portion upwardly to said upper portion of said reactor;

providing a vessel having side walls, a substantially closed bottom, and open top communicating with the interior of the reactor, said vessel having at least two sections therein;

collecting a portion of said entrained particulate material from the reactor interior in said vessel;

providing heat transfer means in said vessel;

introducing fluidization gas into said vessel to fluidize particulate material collected therein and transfer heat between said particulate material fluidized in said vessel and said heat transfer means;

returning said particulate material in said vessel to said lower portion of said reactor; and controlling the rate of heat transfer separately in each of said at least two sections in said vessel by controlling at least one of the inflow of fluidization gas and discharge of said particulate material separately in each section of the vessel.

15. The process as recited in claim 14 wherein:

said controlling of the discharge of said particulate material comprises flowing particulate material from one of said sections of said vessel to an adjacent section of said vessel.

16. The process as recited in claim 14 wherein:

said providing heat transfer means comprises providing at least one evaporator section in at least one section of said vessel and providing at least one superheater section in at least one section of said vessel; and said controlling the rate of heat transfer comprises separately controlling the heat transfer to said at least one evaporator section and said at least one superheater section.

17. The process as recited in claim 15 wherein:

said providing heat transfer means comprises providing at least one evaporator section in at least one section of said vessel and providing at least one superheater section in at least one section of said vessel; and said controlling the rate of heat transfer comprises separately controlling the heat transfer to said at least one evaporator section and said at least one superheater section.

18. The process as recited in claim 14 wherein:

said controlling the rate of heat transfer comprises controlling the velocity of the fluidization gas in at least one section of said vessel to control the heat transfer coefficient for contact between said particulate material and said heat transfer means.

19. The process as recited in claim 15 wherein:

said controlling the rate of heat transfer comprises controlling the velocity of the fluidization gas in at least one section of said vessel to control the heat transfer coefficient for contact between said particulate material and said heat transfer means.

20. The process as recited in claim 17 wherein:

said controlling the rate of heat transfer comprises controlling the velocity of the fluidization gas in at least one section of said vessel to control the heat transfer coefficient for contact between said particulate material and said heat transfer means.

* * * * *